United States Patent [19]

Davis

[11] 4,173,177

[45] Nov. 6, 1979

[54] DECORTICATOR AND SEPARATOR FOR SEED PRODUCTS

[76] Inventor: Floyd O. Davis, 2326 E. Buckeye Rd., Phoenix, Ariz. 85034

[21] Appl. No.: 926,453

[22] Filed: Jul. 20, 1978

[51] Int. Cl.[2] ..... B02B 3/04

[52] U.S. Cl. ..... 99/618; 99/574; 99/621; 99/628

[58] Field of Search ..... 99/601, 609, 585, 621, 99/618, 628, 529, 525, 519, 574

[56] References Cited

U.S. PATENT DOCUMENTS

| | | | |
|---|---|---|---|
| 234,584 | 11/1880 | Kitchens | 99/609 |
| 807,551 | 12/1905 | Gordon | 99/617 |
| 1,320,968 | 11/1919 | Baudendistel | 99/618 |
| 3,835,766 | 9/1974 | Satake | 99/618 |
| 4,034,665 | 7/1977 | McFarland | 99/574 |

FOREIGN PATENT DOCUMENTS

| | | | |
|---|---|---|---|
| 86311 | 4/1957 | Netherlands | 99/618 |

*Primary Examiner*—Edward J. McCarthy
*Attorney, Agent, or Firm*—Warren F. B. Lindsley

[57] ABSTRACT

An improved apparatus for hulling and separating loosened seed hulls from kernels of meat employing compartmentized separator for the meat products.

13 Claims, 15 Drawing Figures

DECORTICATOR AND SEPARATOR FOR SEED PRODUCTS

BACKGROUND OF THE INVENTION

This invention relates to seed processing and more particularly to a decorticator-separator apparatus for compartmentized hulling and separating of loosened seed hulls from kernels of meat.

1. Field of the Invention

This invention is directed to seed decorticating and separating apparatus which hulls the seed then segregates the loosened seed hulls from the kernels of meat and conveys the hulls and meat kernels to different processing lines.

In the processing of seed products it is necessary to extract all or substantially all of the hulls from the kernels of meat in order to render the meats useable for a large variety of food products. The need for more refined full separation becomes increasingly important as more glandless seed products are processed.

2. Description of the Prior Art

Heretofore seed products have passed from saw linters to remove excess lint from the seeds to seed hullers where the hulls are cut to loosen them from their meat contents to beaters, shakers, and separators which remove the hulls from the kernels of meat. The meats are then conveyed to a press room for forming food products and the hulls to an animal feed processing line or the like for industrial uses.

The known hullers have been unable to hull seeds unless they pass through a de-linting operation first whereby most of the lint is taken off the seed prior to hulling. Beaters, shakers and separators have been unsuccessful in completely separating all of the hulls from the kernels of meats particularly undelinted cotton seeds, safflower seeds and the like. Therefore, meats have been lost through their mixture with the hulls, and hull slivers have contaminated and even made unfit for use or sale such meat products. These hull slivers could not be removed from the meat products by the prior art methods and apparatus without sacrificing a great deal of meat protein, and a large run around of uncut seeds which had to be reprocessed again to be re-hulled

SUMMARY OF THE INVENTION

In accordance with the invention claimed a new and improved apparatus has been provided which decorticates all the seed in one pass with no run around of uncut seed, and separates loosened seed hulls from their kernels of meat with or without taking the lint from the seed.

It is, therefore, one object of this invention to provide a new and improved separator for separating kernels of meat from loosened hulls of seed products.

Another object of this invention is to provide a new and improved decorticator which hulls the seeds individually and substantially along their longitudinal axes.

A further object of this invention is to provide an improved decorticator which continually cleans itself during a continuous decorticating operation.

A still further object of this invention is to provide an improved separator for loosening hulls from seed products which employs a plurality of different replaceable screens for separating kernels of meat according to size.

A still further object of this invention is to provide an improved decorticator in which the operating parts are protected if foreign objects are accidentally introduced with the seed products.

Further objects and advantages of this invention will become apparent as the following description proceeds and the features of novelty which characterizes this invention will be pointed out with particularity in the claims annexed to and forming part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
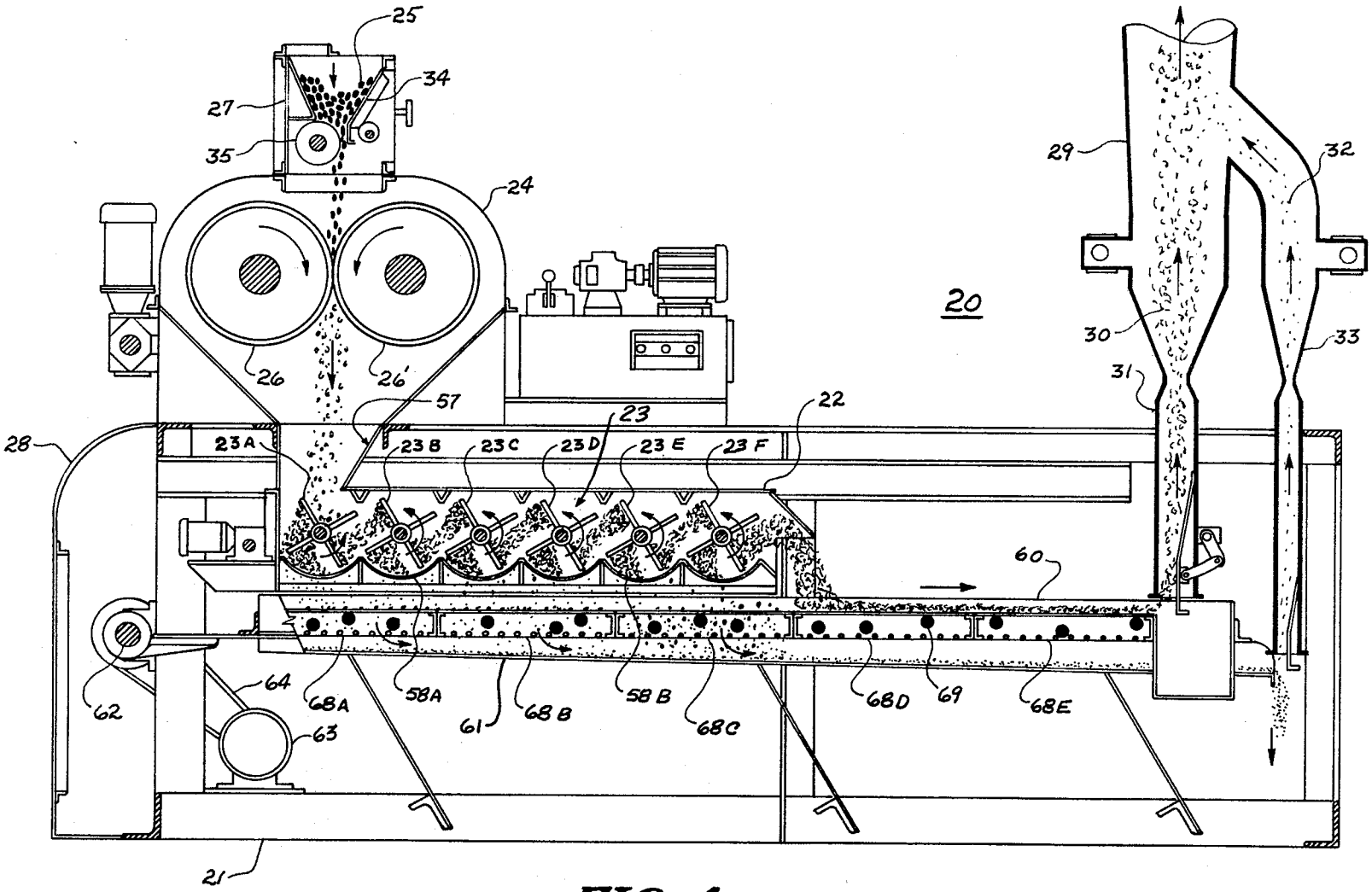
FIG. 1 is a front view of a decorticator-separator apparatus for seed products and embodying the invention.

Referring more particularly to the drawing by characters of reference, FIG. 1 discloses a front view of decorticator-separator 20 for seed products comprising a frame 21 on which is supported in a horizontal arrangement a fixed compartmentized screening apparatus 22 which has mounted over it in a coplanar arrangement a plurality of parallelly mounted spiked rollers 23 comprising spike rollers 23A–23F for beating meats from the hulls and lint of the seeds products being processed.

A decorticator 24 is mounted directly over one of the series mounted parallel arrangement of the spiked rollers 23 for feeding the hulled seeds and their meat products into their spiked rollers. As noted from FIG. 1, the decorticator 24 has mounted directly over it for feeding a seed product 25 into it and between a pair of its hulling rollers 26, 26' a hopper 27 for receiving and dispensing uncut seeds. A steel housing 28 completely encloses the decorticator-separator apparatus 20 to render the device relatively dust free during its operation.

At the right end of the beating and screening apparatus 22, as shown in FIG. 1, is mounted a means 29 for drawing a negative pressure on the hulls to draw off of the vibratory screening apparatus the relatively coarse or large hulls 30 through one passageway 31 and the relatively fine hulls 32 through a separate passageway 33. As noted from FIG. 1, the passageways 31 and 32 merge downstream from the beating and screening apparatus 22 and are directed from there through hull and flower separators (not shown) before being collected for suitable disposal in manners known in the trade.

It should be noted from FIG. 1 that hopper 27 for the seed products comprises a trough 34 and a feed roller 35 which may be adjustably positioned to control the flow of the seed product into decorticator 24 and between rollers 26, 26' of decorticator 24.

Figure 2:
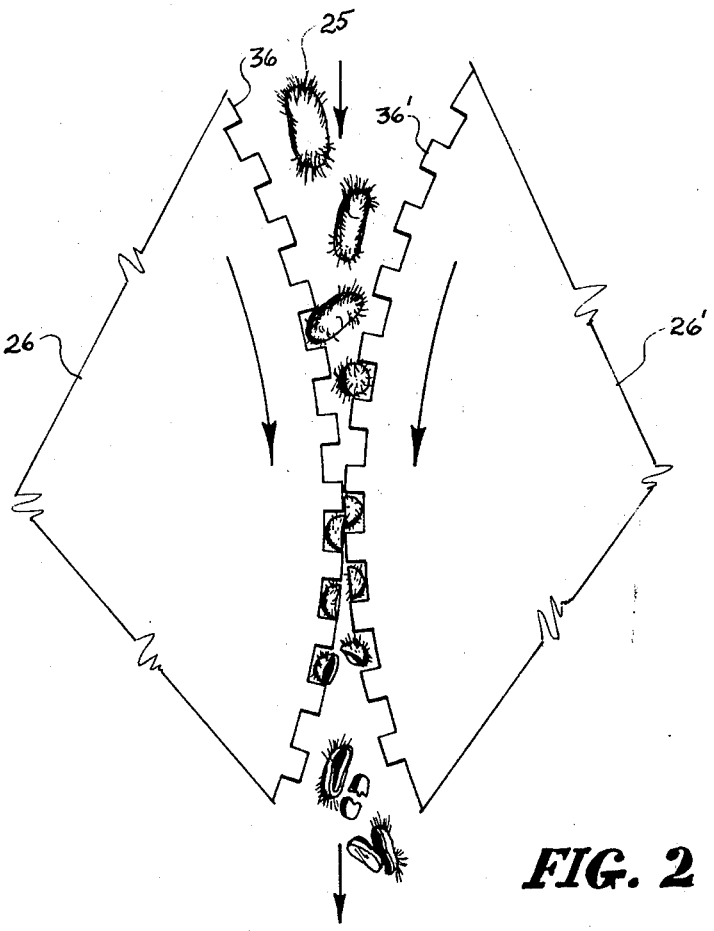
FIG. 2 is a partial diagrammatic view of the hulling rolls of the decorticator illustrating the movement of the seeds into the grooves of the rolls and the separated hulls and kernels leaving these grooves.

FIGS. 2–6 disclose details of rollers 26, 26' with FIG. 2 illustrating that cutting ribs 36, 36' of rollers 26, 26' individually line up one or more of the seeds 25 within the grooves of the cutting ribs longitudinally of the cutting ribs which cause the seed hulls to be sheared substantially along their axes. The kernels of meat may also be sheared in half longitudinally of their axes as illustrated by this figure of the drawing.

Figure 6:
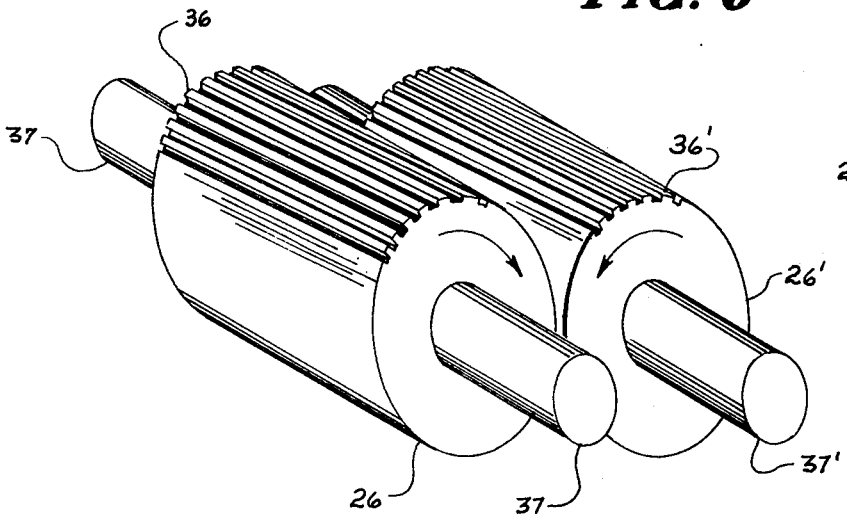
FIG. 6 is a perspective view of the rolls of the decorticator shown in FIGS. 1 and 4 illustrating the groove configuration.
Figure 7:
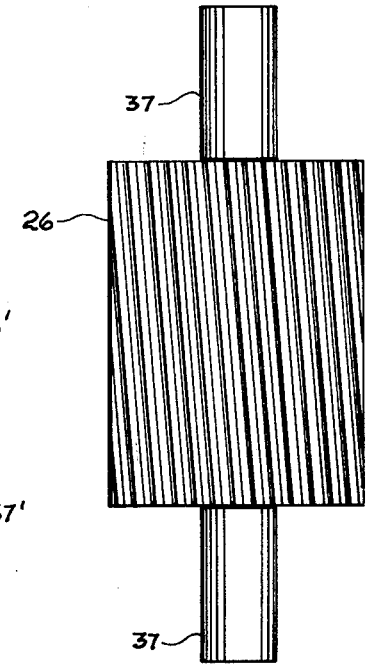
FIG. 7 is a plan view of one of the rolls shown in FIG. 6 showing the groove lead end to end.

FIGS. 6 and 7 illustrate that cutting ribs 36, 36' lead laterally of the longitudinal axis of the rollers in a parallel arrangement so that the seeds dropped onto the cutting ribs are moved into the gap between rollers 26, 26' and sheared, as shown in FIG. 2.

Figure 3:
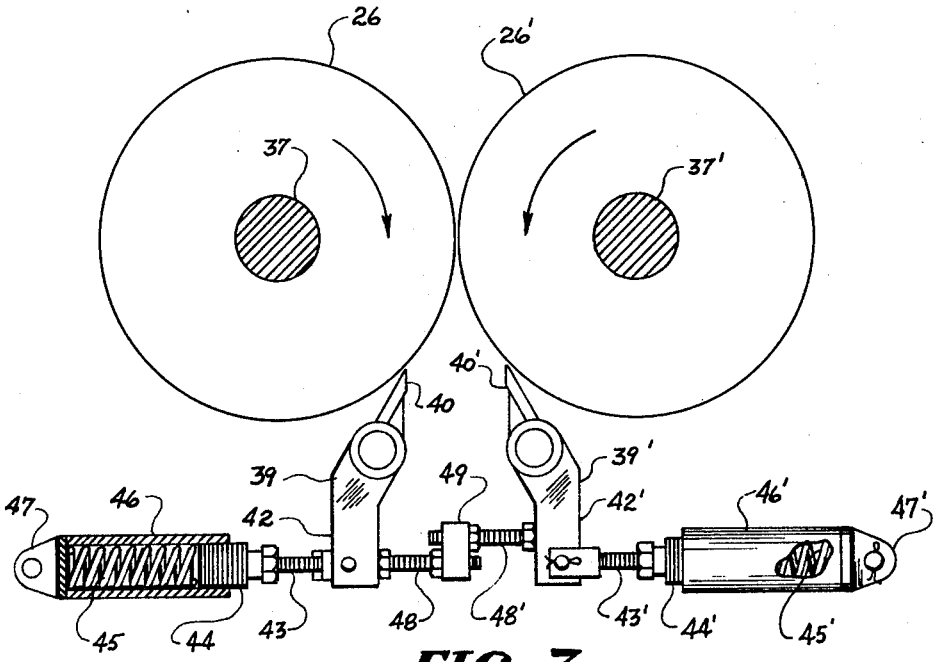
FIG. 3 is a view partly in section of the self-cleaning control mechanism for the rolls of the decorticator shown in FIG. 1.
Figure 4:
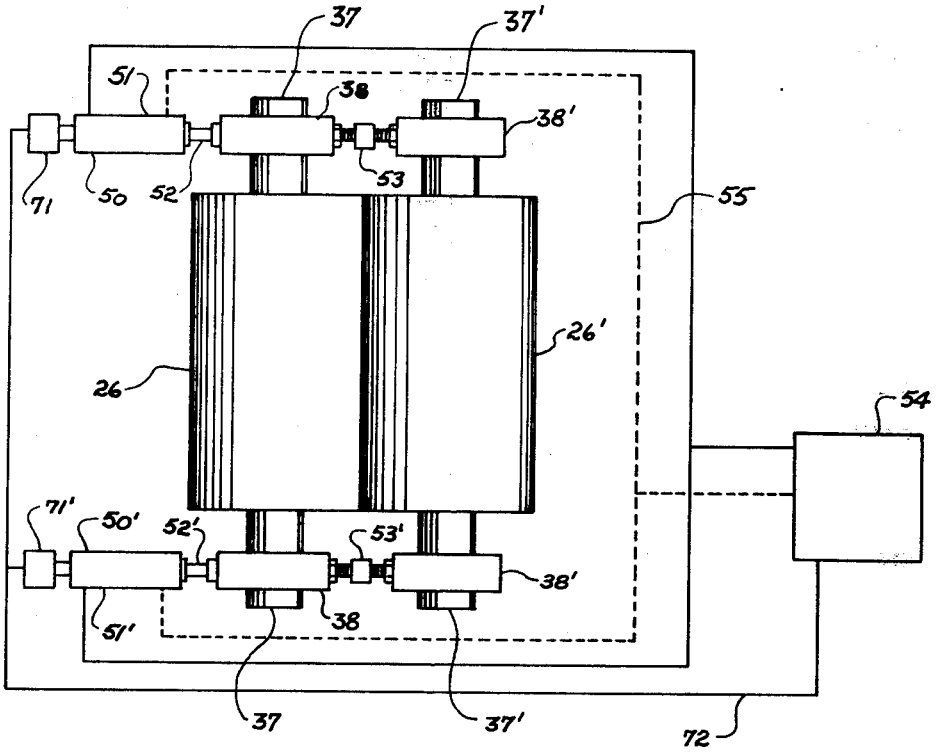
FIG. 4 is a plan view of the rolls of the decorticator shown in FIG. 3 illustrating diagrammatically a hydraulic control means for the foreign object control mechanism.

As noted from FIG. 3, shafts 37, 37' of rollers 26, 26' are suitably journaled in a pair of bearings 38, 38', shown in FIG. 4, to be maintained apart a given distance to avoid functional engagement of their cutting ribs 36, 36' but still remaining close enough to provide the desired seed hull shearing effect.

Figure 5:
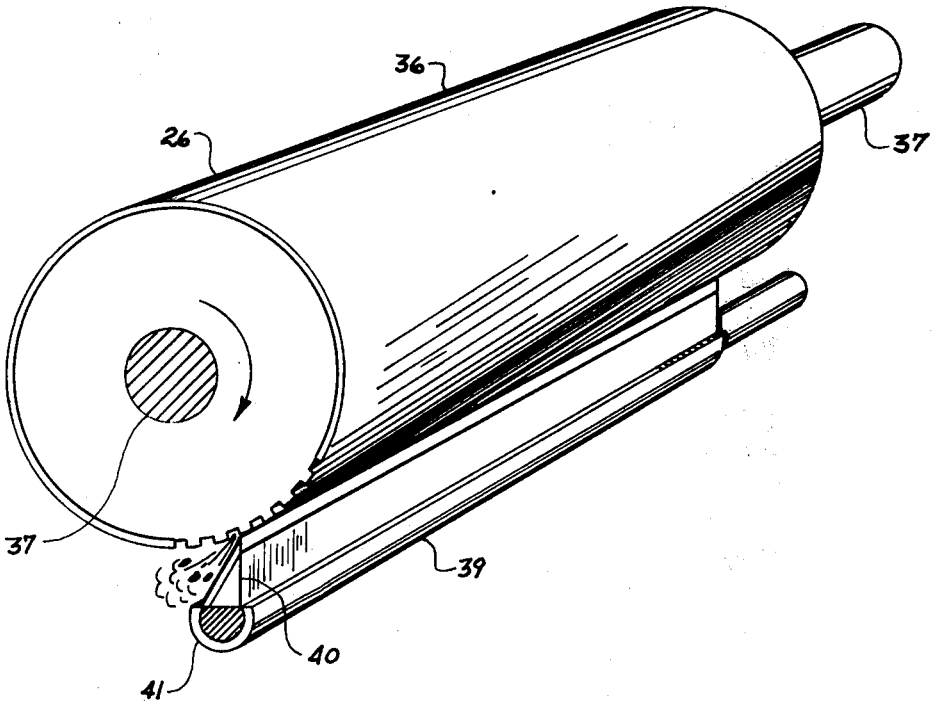
FIG. 5 is a perspective view of one of the rolls shown in FIG. 3 illustrating that the self cleaning mechanism extends substantially across the length of the roll.

Rollers 26, 26' are provided with cleaning mechanisms 39, 39', respectively, which are each arranged to extend along the outer periphery of its respective roller longitudinally thereof in the manner shown in FIG. 5. The cleaning mechanisms may comprise tapered triangular blade configurations 40, 40' which are each pivotally mounted at their axis to form part of levers 42, 42'. The free ends of levers 42, 42' are attached to piston rods 43, 43' and their associated pistons 44, 44' which in turn are biased by suitable springs 45, 45' or other suitable means to cause the free ends of the tapered triangular blade configuration to closely approach the cutting ribs on rollers 26, 26'. The cylindrical housings 46, 46' for pistons 44, 44' are provided with flanges 47, 47' for attachment at any suitable place to housing 24 of the decorticator mechanism. As shown in FIG. 3 the movement of the ends of levers 42, 42' attached to their respective piston rods 43, 43' are provided with suitable adjustably mounted stops 48, 48' which engage with a portion 49 of housing 24 to permit the ends of the tapered blades 40, 40' to move back to and be maintained at a selective distance from the outer surface of the cutting ribs 36, 36' on rollers 26, 26'. FIG. 5 also illustrates that a negative pressure or reverse turbulance occurs at or near the surface of roller 26 and the tip of tapered blades 40 which aids in dislodging any material that may cling to the cutting ribs 36 of the roller.

FIG. 4 also discloses foreign object control mechanisms 50, 50' for rollers 26, 26' which comprises a pair of hydraulic cylinders 51, 51' which employ piston rods 52, 52' that are attached to bearings 38, 38' of rollers 26, 26'. The bearings 38 of roller 26 are each connected to bearings 38' at each end of shaft 37' of roller 26' by adjustable right and left hand threaded bolts 53, 53' of the type shown in FIG. 4. As shown, each hydraulic cylinder is connected to a suitable accumulator or sump 54 by suitable fluid lines 55 in a well known manner.

Thus, if a stone, bolt or other foreign matter larger than the seeds being processed is passed with the seeds 25 from hopper 27 into decorticator 24 and between its rollers 26, 26', it will not destroy the cutting ribs on rollers 26, 26' or their bearings 38, 38', since the rollers are under a pre-set pressure at the accumulator 54 and maintained at such pressure by dump valve 71 and 71'. The foreign matter passing between rollers 26, 26' will tend to spread these rollers apart from each other, thus increasing pressure at dump valves 71 and 71'. This action causes the dump valves to release and hydraulic fluid will flow back through return line 73 causing rollers 26 and 26' to spread apart under the pressure of the foreign matter permitting the foreign matter to pass therethrough. When the foreign matter has passed, the pressure returns to normal and cylinder 51 and 51' resets automatically to normal running pressure, letting rollers 26 and 26' to return to their normal setting.

FIGS. 11–14 illustrate in more detail the movement of a foreign object, such as a bolt 56, between rollers 26, 26' in the manner described above and showing the function of the hydraulic cylinder 51 which is similar to cylinder 51' in moving roller 26 away from roller 26' to permit bolt 56 to move past the rollers without damage thereto.

The seed products including its split or cut hulls and meat kernels after passing between rollers 26, 26' are then dropped under the action of gravity into a chute 57 formed in frame 21 above the first of the sequence of the parallelly arranged spiked rollers 23. These spiked rollers are journaled to rotate in unison in the same direction and are parallelly arranged in juxtaposed position such that the hulls and meat kernels of the split seed products are agitated by one spiked roller to loosen the hulls from the kernels of meat of the seed products and then moved to the next spiked roller and agitated further with some of the kernels of meat dropping through the screen of each respective roller until the last spike roller discharges the hulls and any remaining meat product onto a vibrating screen 60.

Figure 8:
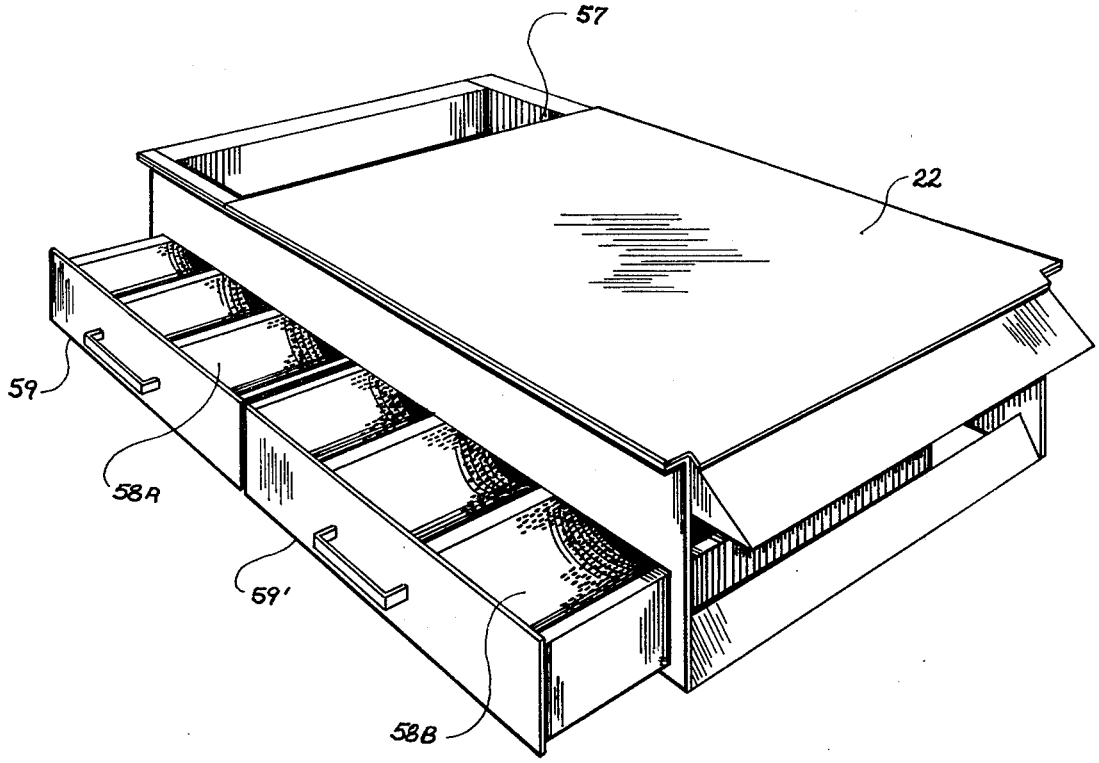
FIG. 8 is a perspective view of the beater and screening compartment of the apparatus shown in FIG. 1 and illustrating the removable drawers with changeable screens.

As noted from FIGS. 1 and 8, the beating and screening apparatus 22 comprises not only the spiked rollers 23A–23F but also two replaceable arcuate screens 58A–58B associated with these rollers mounted in two drawers 59 and 59' forming a part of the screening apparatus.

As the hulls and meat kernels of the seed products are dropped onto the removling spiked roller 23A the hulls and meat kernels are separated with the kernels of meat of a given size either the smallest or the largest of a given sequence of sizes falling through the first arcuate screen 58A having a corresponding size mesh opening onto a vibratory screen mechanism 60 directly below.

FIG. 8 illustrates how the arcuate screens are arranged in drawers 59 and 59' so that they may be readily replaceable and or serviced by merely pulling open drawers 59 and 59' to expose them to the operator of the apparatus.

As noted from FIG. 1, when spiked rollers 23A–23F rotate they agitate the hull and meat kernel combination causing one size of the meat kernels handled by spike rollers 23A to 23C to pass through its screens 58A and onto the vibrating conveyor 60. The remaining portion of the hulls and meat kernels are moved by the spikes of the rotating spiked roller 23C into the path of movement of the spikes of spiked roller 23D to 23F. A further size of the meat kernels then drops through the mesh openings of screens 58B associated therewith during the hull and meat kernel agitation caused by the rotation of spiked rollers 23D–23F. This type of action continues sequentially past all of the spiked rollers in this assembly with like or different size mesh opening existing in the respective screens. By the time the product being agitated by the spiked rollers 23A–23F has reached spiked roller 23F the meat of the seed product has been separated from the hulls.

Figures 9, 10:
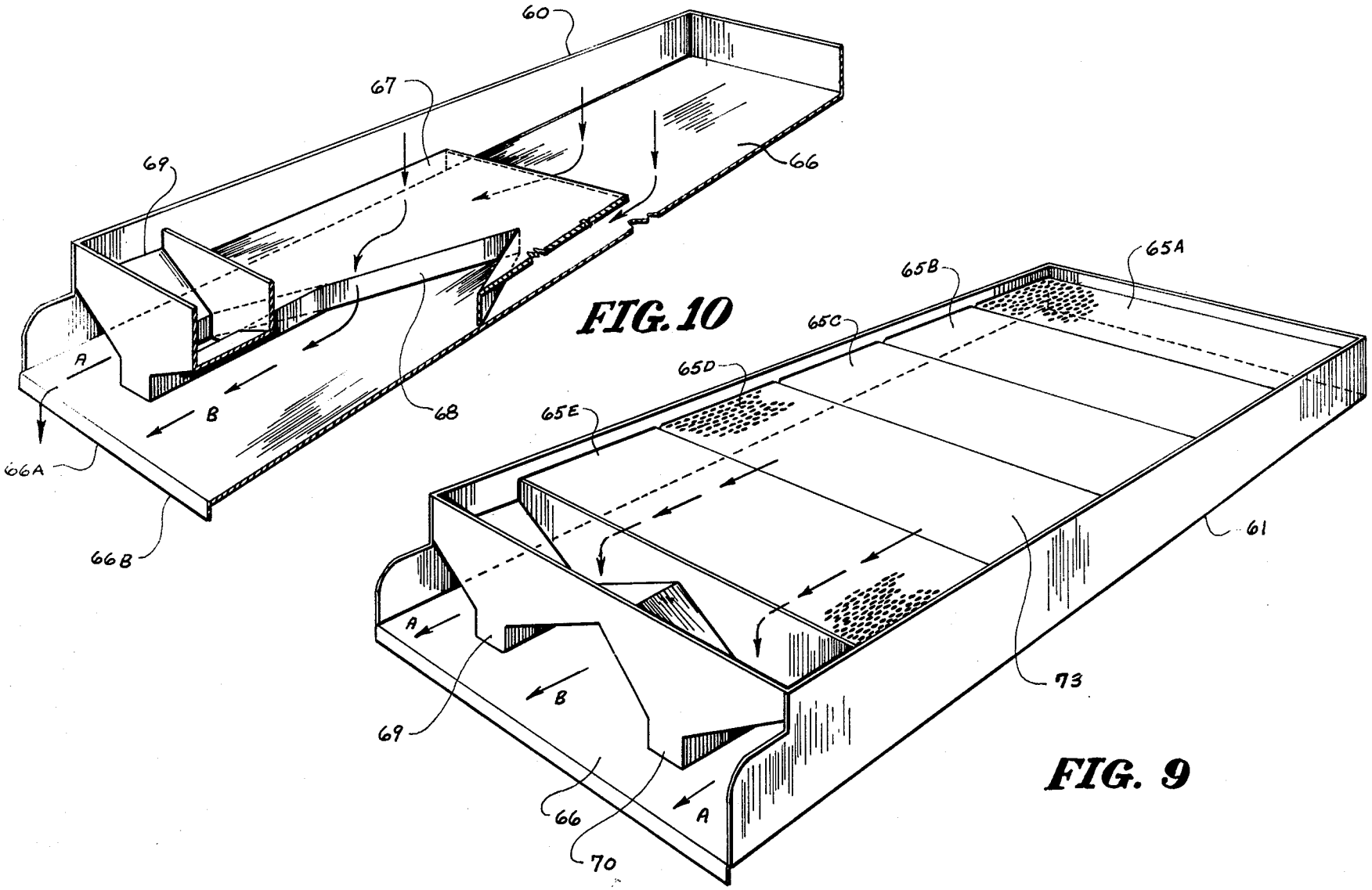
FIG. 9 is a perspective view of the bi-level vibratory screening portion located beneath the beater and screening compartment shown in FIG. 1.
FIG. 10 is a perspective view of an internal portion of the bi-level segregating means of the vibratory screen shown in FIG. 9 illustrating two of the flow paths designed into the vibratory screen.
Figure 11:
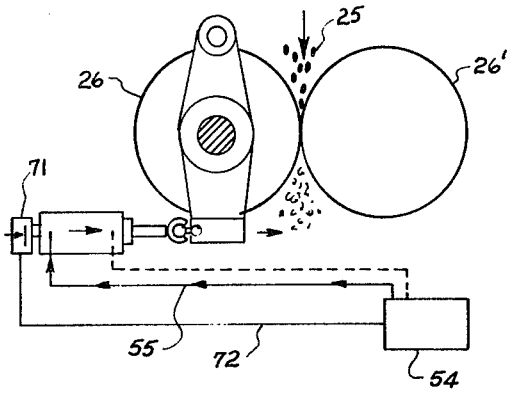
FIGS. 11–14 diagrammatically illustrate the functioning of the foreign object control mechanism of the decorticator.
Figure 12:
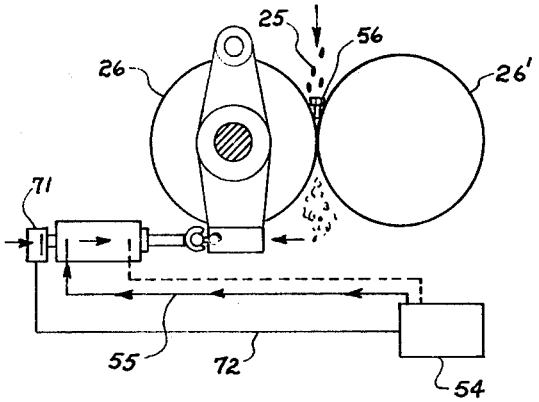
Figure 13:
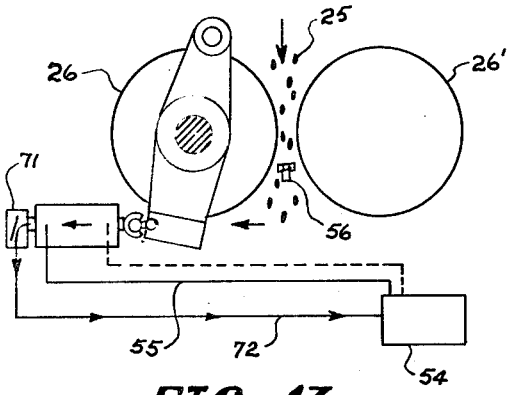
Figure 14:
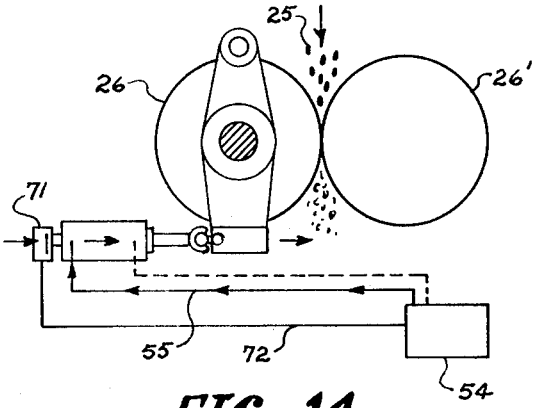

The vibratory screen 60, as shown more clearly in FIGS. 9 and 10, comprises a screening mechanism 61 which is actuated by an eccentric shaft 62 which is rotated by a motor 63 through a pulley arrangement 64 in the usual manner.

The screening mechanism 61 comprises a plurality of screened sashes 65A–65E which may be replaceably positioned in the screening mechanism with the mesh size openings of the sashes being of like or different size openings. The kernels of meat of the seed product which passes through the mesh opening of the first few screened sashes such as sashes 65A–65E for example, fall directly onto a surface 66 of the vibratory conveyor 60 and are moved by vibration along a given path to discharge end 66A as shown in FIG. 10. The kernels of meat of the seed products that pass through the later screened sash, for example, screened sashes 65D and 65E, drop onto a platform 67 and then are vibrated along another different path to the discharge end 66B of surface 66.

Figure 15:
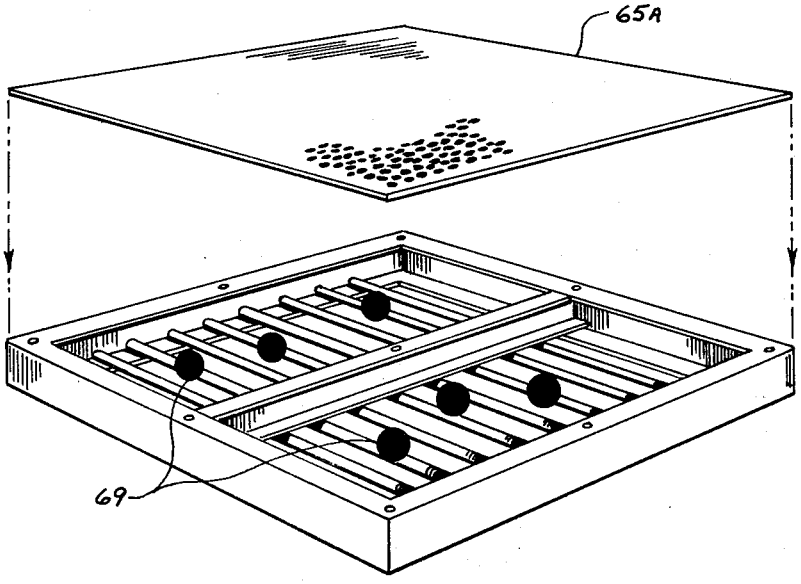
FIG. 15 is a perspective view of a self cleaning sash mechanism utilized in the vibratory screen compartments disclosed in FIG. 1.

FIGS. 1, 9 and 10 illustrate that the kernels of meat dropping through the arcuate screens 58A and 58B drop onto and through screen sashes 65A–65C pass through a series of compartments 68A–68E each containing a plurality of rubber balls 69 which move around in these compartments as shown in FIG. 15 thereby maintaining the lower screening surface 73 of the compartments free from any clogging of the meat products and permitting them to fall onto the vibrating surface 66.

As shown in FIGS. 1, 9 and 10, the kernels of meat are dropped through screens 58A and 58B by the agitating action of the spiked rollers 23A–23F with the hulls being finally discharged onto the vibratory conveyor 60 on sashes 65D and 65E and then moved therealong under vibratory action to the opening of passageway 30 of the negative pressure means 29. At this point they are picked up by suction action and transferred to a point of use.

It should be noted that the decorticator 24 and the frame 21 of the decorticator/separator 20 are covered and closed by a housing configuration which places the interior thereof under the negative pressure of means 29. In this manner, the exit under operating conditions of dust and air born products is through the negative pressure means 29 thus meeting the present day standards of OSHA.

The meat kernels of the smallest sizes are dropped through the screens 58A and onto conveyor 60 where they are vibrated and pass through screen sashes 65A–65C, compartments 68A–68C to surface 66 of the vibratory conveyor 60. The vibratory conveyor 60 moves this size kernel along the paths marked by arrows A in FIGS. 9 and 10 to a suitable discharge or collection means (not shown).

The coarse size kernels of meat are dropped through screens 58B and onto conveyor 60 where they are vibrated through screens sashes 65D and 65F onto platform 67 of the vibratory conveyor 60 where they are vibrated until the drop off of shelf 68 onto surface 66 of this vibratory conveyor. These relatively large or coarse kernels of meat are moved off of the conveyor mechanism along the path marked by the arrows B in FIGS. 9 and 10.

FIG. 9 illustrates the troughs 69 and 70 which discharges to suitable containers (not shown) the waste products of the hull by product of the seeds which is not picked up under suction and discharged through the negative pressure means 29.

It should be noted from FIG. 1 that the passageway 33 for the fine or slivers of hulls is positioned directly over the discharge end of the platform 66 of the vibratory conveyor 60. The negative pressure in this passageway provides a final hull cleaning action for the meat product before it is further processed or used.

Although but a few embodiments of the present invention have been illustrated and described, it will be apparent to those skilled in the art that various changes and modifications may be made therein without departing from the spirit of the invention or from the scope of the appended claims.

What is claimed is:

1. A decorticator/separator apparatus for seed products comprising:

a frame, a decorticator mounted on said frame and comprising a pair of juxtapositioned parallelly arranged rollers journaled for rotation about their axes in a direction toward each other, a hopper mounted on said frame substantially vertically above said decorticator for dispensing seeds between the rollers of said decorticator, said rollers being spaced apart from each other a small predetermined distance, each of the outer surfaces of said rollers being provided with cutting ribs extending in a parallel arrangement with a longitudinal lead thereof which cutting ribs cooperate to receive in grooves therebetween the seeds, the seed being turned by said cutting ribs on each of said rollers when engaging therewith to extend longitudinally of the cutting ribs on the rollers in the grooves existing between the cutting ribs as said rollers rotate at a differential speed, the cutting ribs on said rollers shearing the hulls of the seeds as the seeds pass between said rollers, and a separator mounted below said decorticator for receiving the hull sheared seeds for separating the hulls from the kernels of meat of the seeds, said separator comprising a plurality of spiked rollers journaled on said frame in a side by side parallel arrangement and rotating in unison in a common direction, said decorticator dropping the sheared seed products on top of one of said spiked rollers, said one of said spiked rollers while rotating moving said seed products over an associated screen for separating at least some of the kernels of meat of said seed products from the hulls of the seed product and moving the rest of the seed products into the path of movement of the next juxtapositioned spiked roller.

2. The decorticator/separator set forth in claim 1 wherein:

each set of said spiked rollers has a separate associated screen mounted below it for separating at least some of the kernels of meat of said seed products from the hulls of the seed product agitated by the associated roller; and said spiked rollers sequentially moving the seed products from one spiked roller to another until all spiked rollers have agitated the seed products with the last spiked roller discharing the hulls of the seed product therefrom.

3. The decorticator/separator set forth in claim 2 wherein:

said last spiked roller discharges the hulls onto a vibratory conveyor.

4. The decorticator/separator set forth in claim 3 in further combination with:

said vibratory conveyor mounted directly below the screens associated with said spiked rollers for receiving the kernels of meat of said seed product.

5. The decorticator/separator set forth in claim 4 wherein:

said vibratory conveyor comprises a plurality of screen sashes, some of said screen sashes comprising different size mesh openings for segregating kernels of meat of said seed products by selectively passing therethrough predetermined size kernels.

6. The decorticator/separator set forth in claim 5 wherein:

said screens associated with said spiked rollers are replaceably mounted within drawers removably mounted on said frame.

7. The decorticator/separator set forth in claim 6 wherein:

said screens associated with said spiked rollers are of an arcuate configuration conforming to the path formed by the rotation of the associated spiked roller.

8. The decorticator/separator set forth in claim 4 wherein:

said vibratory conveyor comprises a platform mounted below said screens associated with said spiked rollers for providing a plurality of segregated paths for the kernels of meat passed by said screens associated with said spiked rollers to move under vibratory action along said vibratory conveyor.

9. The decorticator/separator set forth in claim 3 in further combination with:

means for applying a vacuum to the hulls discharged onto the vibratory conveyor for drawing them into a discharge passageway.

10. The decorticator/separator set forth in claim 8 in further combination with:

means for applying a vacuum to the kernels of meat being discharged by said conveyor for removing any hull products still existing therewith.

11. The decorticator/separator set forth in claim 9 in further combination with a housing around said frame, and said means for applying a vacuum to said hulls places the interior of said housing under negative pressure conditions to render the exterior of decorticator/separator substantially dust free from the action occurring inside of said decorticator/separator.

12. A decorticator/separator apparatus for seed products comprising:

a frame, a decorticator mounted on said frame and comprising a pair of juxtapositioned parallelly arranged rollers journaled for rotation about their axes in a direction toward each other, a hopper mounted on said frame substantially vertically above said decorticator for dispensing seeds between the rollers of said decorticator, said rollers being spaced apart from each other a small predetermined distance, each of the outer surfaces of said rollers being provided with cutting ribs extending in a parallel arrangement with a longitudinal lead thereof which cutting ribs cooperate to receive in grooves therebetween the seeds, the seed being turned by said cutting ribs on each of said rollers when engaging therewith to extend longitudinally of the cutting ribs on the rollers in the grooves existing between the cutting ribs as said rollers rotate at a differential speed, the cutting ribs on said rollers shearing the hulls of the seeds as the seeds pass between said rollers, a separator mounted below said decorticator for receiving the hull sheared seeds for separating the hulls from the kernels of meat of the seeds, said cutting ribs on each of said rollers defining square groove configurations therebetween and extending laterally of the longitudinal axis of said roller in parallel side by side arrangement with a spiral lead from end to end, and means for cleaning the surfaces of said rollers, said means comprising a pair of scraper blades one mounted to extend longitudinally of the surface of each of said rollers for scraping off of said rollers any seed component which does not drop off of it during rotation of the roller, said scraper being mounted on said frame for close association with its associated roller to cause material to dislodge by air turbulence at a point downstream of the point of seed shearing action of said decorticator.

13. A decorticator/separator apparatus for seed products comprising:

a frame, a decorticator mounted on said frame and comprising a pair of juxtapositioned parallelly arranged rollers journaled for rotation about their axes in a direction toward each other, a hopper mounted on said frame substantially vertically above said decorticator for dispensing seeds between the rollers of said decorticator, said rollers being spaced apart from each other a small predetermined distance, each of the outer surfaces of said rollers being provided with cutting ribs extending in a parallel arrangement with a longitudinal lead thereof which cutting ribs cooperate to receive in grooves therebetween the seeds, the seed being turned by said cutting ribs on each of said rollers when engaging therewith to extend longitudinally of the cutting ribs on the rollers in the grooves existing between the cutting ribs as said rollers rotate at a differential speed, the cutting ribs on said rollers shearing the hulls of the seeds as the seeds pass between said rollers, a separator mounted below said decorticator for receiving the hull sheared seeds for separating the hulls from the kernels of meat of the seeds, said cutting ribs on each of said rollers define square groove configurations therebetween and extending laterally of the longitudinal axis of said roller in parallel side by side arrangement with a spiral lead from end to end, and resilient means for causing at least one of said rollers to move relative to the other when an object foreign to the processed seed product moves between said rollers, said resilient means comprising a pair of fluid operated cylinders each comprising a piston and piston rod mounted to bias a different end of one of said rollers to a predetermined position adjacent the other of said rollers, said pistons moving under the influence of increased pressure from the foreign object moving between said rollers to cause said rollers to separate a greater distance to cause the foreign object to pass therebetween without damaging the cutting ribs on said rollers.

* * * * *